US005927666A

United States Patent [19]

Barkan

[11] Patent Number: 5,927,666

[45] Date of Patent: Jul. 27, 1999

[54] WALL BRACKET

[76] Inventor: Lior Barkan, 39A Kehilat Sphia Sr., Tel-Aviv 69018, Israel

[21] Appl. No.: 09/013,331

[22] Filed: Jan. 26, 1998

[51] Int. Cl.[6] ..... A47B 96/06

[52] U.S. Cl. ..... 248/225.11; 248/289.11; 248/300

[58] Field of Search ..... 248/300, 225.11, 248/220.21, 289.11, 282.1; 29/7, 11

[56] References Cited

U.S. PATENT DOCUMENTS

| | | | |
|---|---|---|---|
| 4,071,216 | 1/1978 | Einhorn | 248/282.1 |
| 4,098,483 | 7/1978 | Pesola et al. | 248/289.11 X |
| 4,185,801 | 1/1980 | Plymoth | 248/282.1 |
| 4,726,554 | 2/1988 | Sorrell | 248/225.11 X |
| 5,518,083 | 5/1996 | Blennert | 248/282.1 X |

FOREIGN PATENT DOCUMENTS

| | | |
|---|---|---|
| 100263 | 12/1991 | Israel . |
| 101418 | 3/1992 | Israel . |

*Primary Examiner*—Ramon O. Ramirez
*Attorney, Agent, or Firm*—Oliff & Berridge, PLC

[57] ABSTRACT

A wall bracket fixed to a wall for supporting an articulated support arm, the bracket being made of a single metal sheet blank bent along a longitudinal axis so as to form an flat wall plate comprising at least one first and at least one second eye hinges projecting from the wall plate, in which all the eye hinges are aligned with one another and extend along the longitudinal axis and are adapted for receiving a hinge shaft.

24 Claims, 6 Drawing Sheets

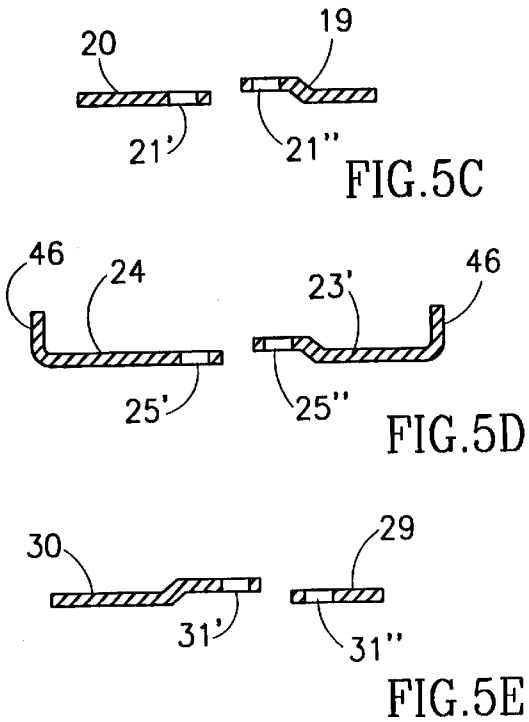
FIG.5C
FIG.5D
FIG.5E
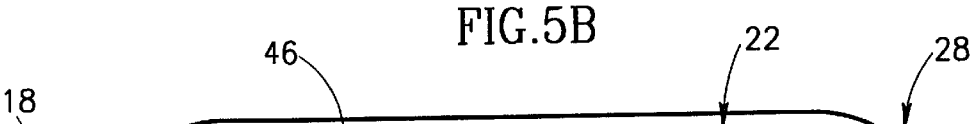
FIG.5B
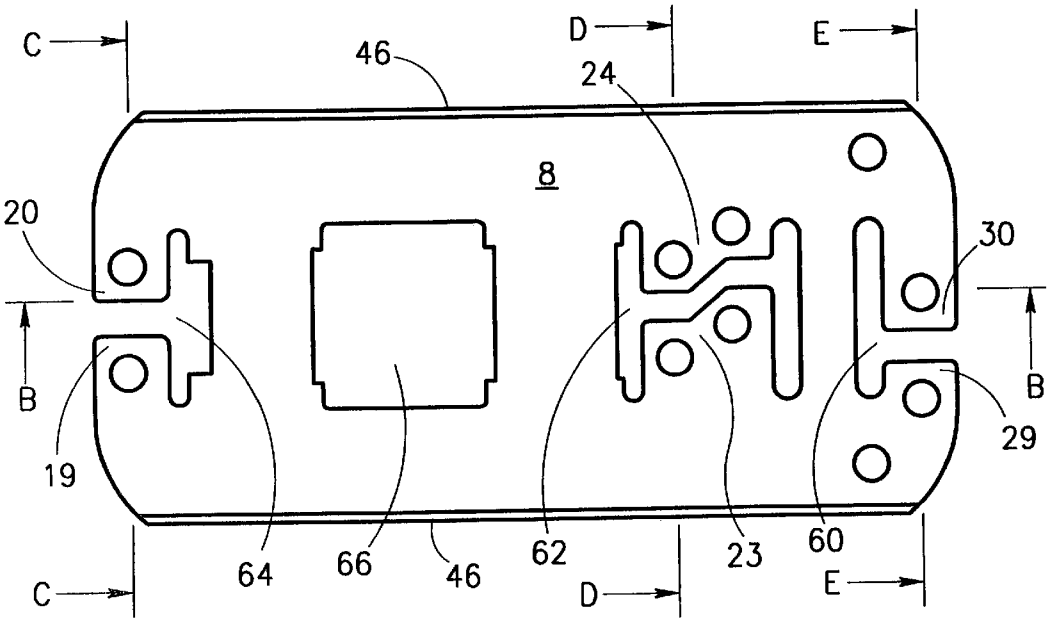
FIG.5A

WALL BRACKET

FIELD OF THE INVENTION

The present invention is in the field of wall brackets of the type used, for example, with a support shelf coupled to the bracket and supporting a television receiver, a monitor or the like. The invention is also concerned with a method of manufacturing such a wall bracket. Although the device according to the invention is referred to as a "wall bracket", it is also concerned with such brackets suitable for attaching to ceilings and accordingly, the term "wall" refers also to ceilings.

BACKGROUND OF THE INVENTION

Wall brackets with which the present invention is concerned typically have an essentially flat plate for mounting onto an essentially vertical wall or the like by bolts, and a hinge member for fixedly or connecting to an end of an arm carrying at its opposed end a shelf supporting a television receiver, a monitor, etc. with suitable means for pitch and yaw adjustment, for convenience of the user. However, a wall bracket may also be used for suspendingly supporting such devices from a ceiling, in which case the support arm is not swingable with respect to the wall bracket.

The heavy weight supported by the shelf and the moment developed at the wall bracket end of the arm owing to the long arm (which in some cases consists of two pivotal links each being approximately 40 cm long), requires a strong wall bracket for mounting by bolts on the wall and which can carry the heavy weight without deforming.

Heretofore, such wall brackets are typically made of a solid metal plate to which a hinge member is attached, for example by welding or by bolts. However, such a wall bracket is heavy and expensive as it is made of solid metal and requires the additional components attached by welding or bolts.

By using the term "eye hinge" hereinafter in the specification, it is refereed to a hinge of the type comprising two looped members attached to the wall bracket with a space between the members, and a hinge shaft extending through the looped members and through a bored end of the support arm for supporting the arm within the space.

It is an object of the present invention to provide an improved wall bracket for supporting a support arm, which wall bracket is manufactured of a single metal sheet blank with no additional components.

SUMMARY OF THE INVENTION

According to the present invention there is provided a wall bracket fixed to a wall for supporting an articulated support arm, the bracket characterized in that it is made of a single metal sheet blank bent along a longitudinal axis so as to form an essentially flat wall plate comprising at least one first and one second eye hinges projecting from the wall plate, all the at least one first and second eye hinges being aligned with one another and extend along the longitudinal axis and are adapted for receiving a hinge shaft.

According to the present invention, the hinged eyes have an essentially U-like shape with the leg portions thereof connected to the wall plate and were each two facing edges of adjacent eye hinges comprised axial projecting shoulders for positioning retaining rings coaxially with the hinge eyes, so as to radially position the hinge shaft within the hinge eyes, the rings also serve as washers for reducing friction between the support arm and the hinges.

According to a preferred embodiment, the wall bracket further comprises at least two overlapping portions each consisting of a first and second member, each extending from an opposite direction, and a hole extending through each one of said portions.

Still preferably, a first one of said portions is adjacent the first eye hinge and a second one of said portions is adjacent the second eye hinge. Still preferably, the first overlapping portion is adjacent a bottom end of the wall bracket and a third overlapping portion is provided adjacent a top end of the wall bracket. According to one application of the invention, the second overlapping portion comprises two holes, one of which being in alignment with a hole of the first overlapping portion and along the longitudinal axis.

According to a specific application, the horizontal distance between the center of any two holes is not more than about 20 mm, so as to allow fixing the wall bracket by bolts also to a narrow construction bar.

By still preferred embodiment of the invention, the wall plate comprises at least two additional holes adjacent to the top end of the wall bracket, and near the side edges thereof, this forming an essentially T-like configuration together with the holes of the overlapping portions.

For imparting bending resistance to the wall bracket, the side edges of the wall plate are bent along an axis parallel to the longitudinal axis.

In order to prevent lateral deformation of the bracket in a lateral direction, fasteners are inserted into the holes of the overlapping portions, said fasteners being the bolts used for fixing the wall bracket to the wall.

Lateral deformation of the wall bracket according to the invention may also be prevented by welding the members of the overlapping portions. Alternatively, instead of overlapping portions, the wall bracket may comprise essentially equi-leveled, flat portions projecting from opposite sides of the bracket, said flat portions being fixedly attached to one another along their tangential edges, preferably by welding.

When the wall bracket is used as a wall mounted bracket, the support arm is articulated thereto, however when the bracket is used as a ceiling mounted bracket, the support arm is fixedly articulated thereto.

By another aspect of the invention, the wall bracket of the present invention is concealable by a decorative cover. In a specific embodiment the cover snap-fits over the wall bracket by protrusions fitted for attachment to the wall bracket behind the bent side edges thereof.

Still a further aspect of the invention is providing a method for manufacturing a wall bracket for hingingly supporting an articulated support arm to a wall, the method consisting of the following steps:

(a) forming a metal sheet into to a blank including forming suitable openings and holes;

(b) forming at least two axially aligned eye hinges, whereby the blank is laterally deformed so that essentially flat portions project from opposite sides of the wall bracket;

(c) fixedly attaching the flat portions to one another along their tangential edges.

Preferably, before step (b), the side edges of the blank are bent parallel to a longitudinal axis of the blank, and the flat portions are attached by welding.

By a preferred method for manufacturing a wall bracket according to the present invention, the wall bracket comprises at least two overlapping portions with holes therein, the method consisting of the following steps:

(a) forming a metal sheet into to a blank including forming suitable openings, and holes at each member of the overlapping portions;

(b) bending side edges of the blank parallel to a longitudinal axis of the blank;

(c) before, after or during step (b) bending one member of each of the overlapping portions so as to extend parallel to the sheet and essentially flush with a surface of the sheet;

(d) forming at least two axially aligned eye hinges, whereby the blank is laterally deformed and the members of each of the overlapping portions overlap so that the holes become concentric.

In a specific application of the invention, the method further includes forming additional holes in the blank before step (b).

Preferably the wall bracket according to the present invention is manufactured only by pressing processes.

BRIEF SUMMARY OF THE DRAWINGS

For better understanding, the invention will now be described by way of example only, with reference to the accompanying drawings, in which:

FIG. 5*a* is a plain view from above showing a second step of a method for manufacturing a wall bracket according to the present invention;

FIG. 5*b* is a cross-section along line A—A FIG. 5*a;*

FIGS. 5*c* to 5*e* are cross-sectional views along lines C—C; D—D and E—E respectively, in FIG. 5*a;*

DETAILED DESCRIPTION OF A PREFERRED EMBODIMENT

Figure 1:
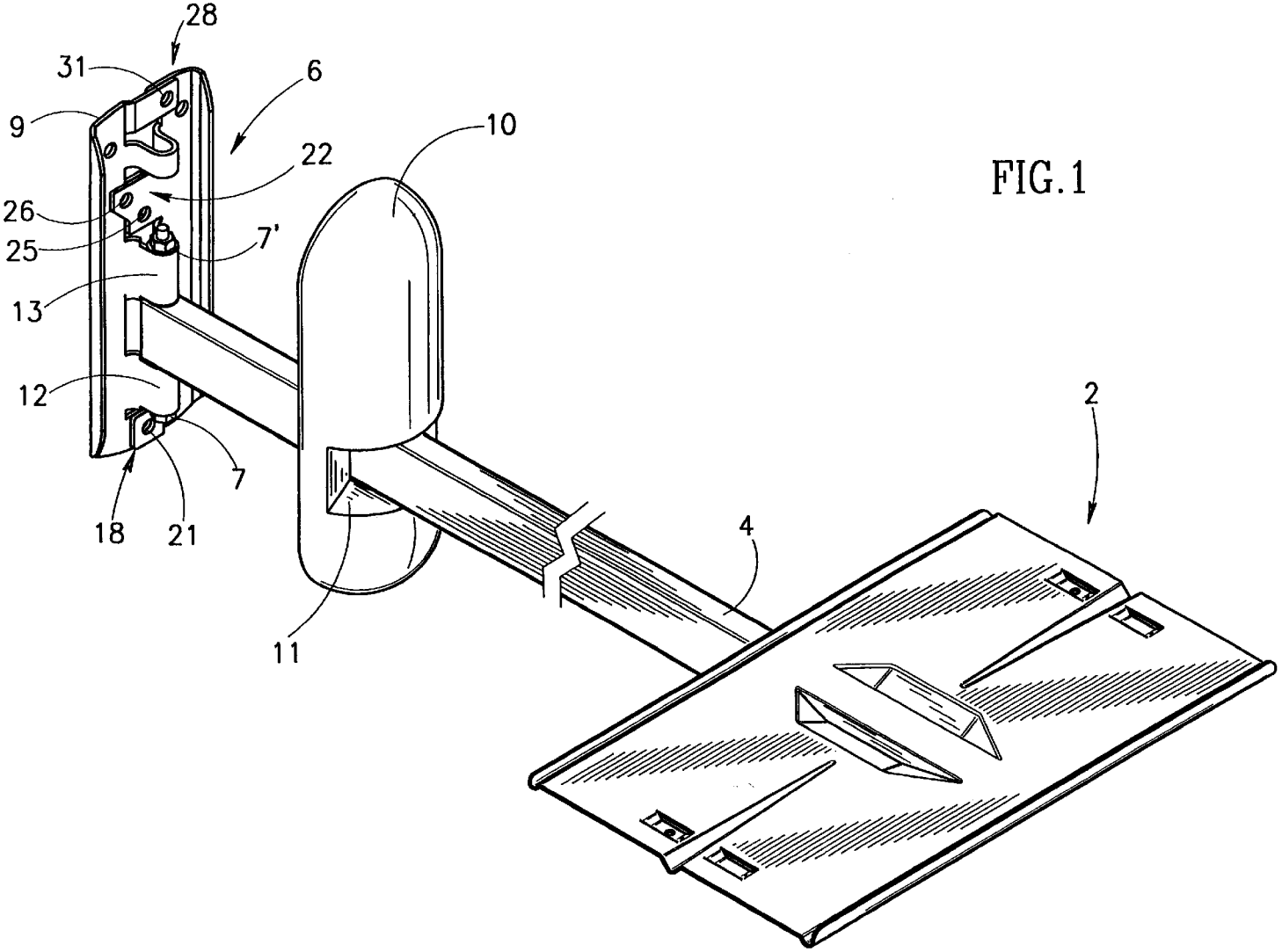
FIG. 1 is a perspective view of a support shelf articulated to a wall bracket according to the present invention, and with a decorative cover detached from the wall bracket.

Attention is first directed to FIG. 1 of the drawings showing a support shelf comprising a substantially rectangular base 2 for supporting a television set or the like, the base 2 being pivotally mounted at an end of a support arm 4 having a substantially rectangular cross-sectional shape with its opposite, bored end pivotally coupled to a wall bracket 6 by means of a hinge shaft 7 as will be later explained.

A decorative cover 10 has the shape of an oval volumetric body with an opening 11 through which the arm 4 projects. The decorative cover 10 is attachable to the wall bracket 6 as will hereinafter be explained in detail.

Figure 2:
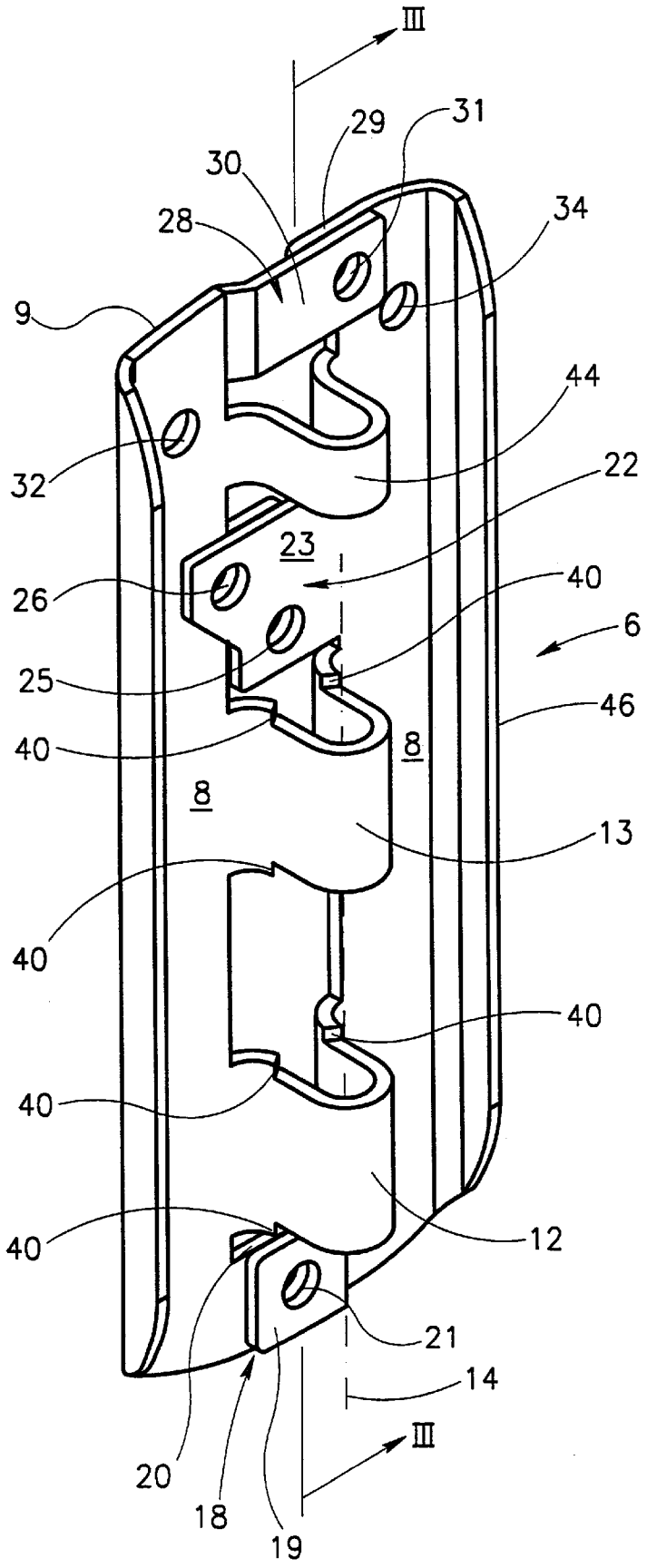
FIG. 2 is a perspective view of the wall bracket in accordance with the present invention.

As can be seen in more detail in FIG. 2, the wall bracket 6 has an essentially rectangular shape with rounded comers. The wall bracket has a plate portion 8 having an essentially smooth wall facing side 9 and at an opposite face there is a first eye hinge 12 at a lower portion thereof and a second eye hinge 13 at a middle portion thereof, the eye hinges having an essentially U-like cross-sectional shape, both eye hinges having a concentric axis 14 extending parallel to a longitudinal axis 16 constituting the centerline of the wall bracket.

As can further be seen, the wall bracket comprises a first overlapping portion 18 consisting of overlapping members 19 and 20 at the bottom portion of the bracket and comprising a hole 21, a second overlapping portion 22 above the top hinge member 13, consisting of overlapping members 23 and 24, and comprising two holes 25 and 26, and a third overlapping portion 28 consisting of overlapping members 29 and 30 at the top portion of the wall bracket and comprising a hole 31. The bracket further comprises two additional holes 32 and 34 at the top portion of the wall bracket, said additional holes being formed on a horizontal line. Holes 21 and 25 of the first and second overlapping portions, respectively, are aligned along the axis 16 of the wall bracket, whereas holes 26 and 31 of the second and third overlapping portions 22 and 28 respectively are laterally diverted from the center line axis 16 in opposed directions, the arrangement being such that the horizontal distance between the centers of holes 26 and 31 does not exceed more than about 20 mm. This arrangement is useful for fixing the wall bracket 6 to a narrow construction beam of a wall.

As can further be seen in FIG. 2, top and bottom edges of both eye hinges 12 and 13 comprise axially projecting abutting shoulders 40, the purpose of which will be hereinafter explained in more detail.

Furthermore, the wall bracket 6 comprises a third U-like bent portion 44 which is formed for manufacturing reasons, namely for uniform stress and deformation of the blank metal sheet during the manufacturing process, which will hereinafter be explained.

The side edges 46 of the wall bracket 6 are bent inwardly along an axis parallel to the center line axis 16 so as to impart bending resistance to the wall bracket 6, as known per se.

Attention is now directed to FIGS. 1 to 3 for understanding how the wall bracket is fixed to a wall and how the support arm 4 is articulated to the wall bracket 6 with the decorative cover 10.

For attaching the wall bracket 6 to a wall (not shown) and to ensure that the wall bracket 6 does not deform under heavy weight of the load supported by the arm 4, at least two bolts 50 should be fixed to the wall through holes 21 and 25 of the overlapping portions 18 and 22 respectively, thus preventing lateral deformation of the wall bracket and deformation of the eye hinges 12 and 13. Preferably two more bolts 52 are used for securing the wall bracket to the wall through the additional holes 32 and 34. However, if the wall bracket 6 is mounted, for example, on a Gibson wall or on a wooden wall, then the device has to be attached to a vertical construction beam, typically having width of up to 38 mm. Accordingly, as mentioned hereinbefore, the horizontal distance between any two holes (not referring to the additional holes 32 and 34) does not exceed 20 mm.

For articulating the support arm 4 to the wall bracket 6, the end of the arm 4 is positioned in the space between the eye hinges 12 and 13 and the hinge shaft 7 is inserted through the eye hinges 12 and 13 and through a bore at the end of the support arm 4 and is than secured by a nut 7'. In order to prevent radial displacement of the hinge shaft 7 and to reduce friction between the support arm 4 and the edges of the hinges 12 and 13, the hinge shaft 7 is inserted also through retaining rings 56 bearing against shoulders 40 of the eye hinges.

When it is required to attach the wall bracket to a ceiling or even to inclined wall, than it is necessary to articulate the support arm to the wall bracket in a manner which prevents swinging of the support arm. This is done by forming the bore of the support arm slightly remote from the end thereof, whereby the end of the arm extends through an opening in the wall plate an extends adjacent the wall and swinging is thus eliminated.

Figure 6B:
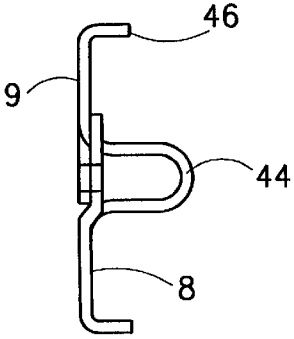
FIG. 6*b* is a cross-sectional view along line IV—IV in FIG. 3, also showing a portion of the arm end a decorative cover used in conjunction with the wall bracket according to the present invention.
Figure 6A:
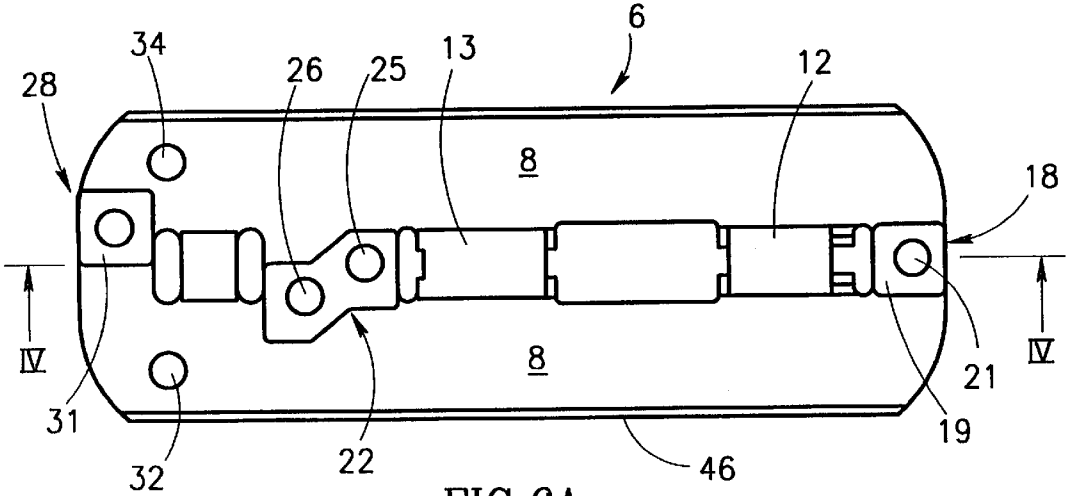
FIG. 6*a* is a plan view from above of a wall bracket in accordance with the present invention.
Figure 4:
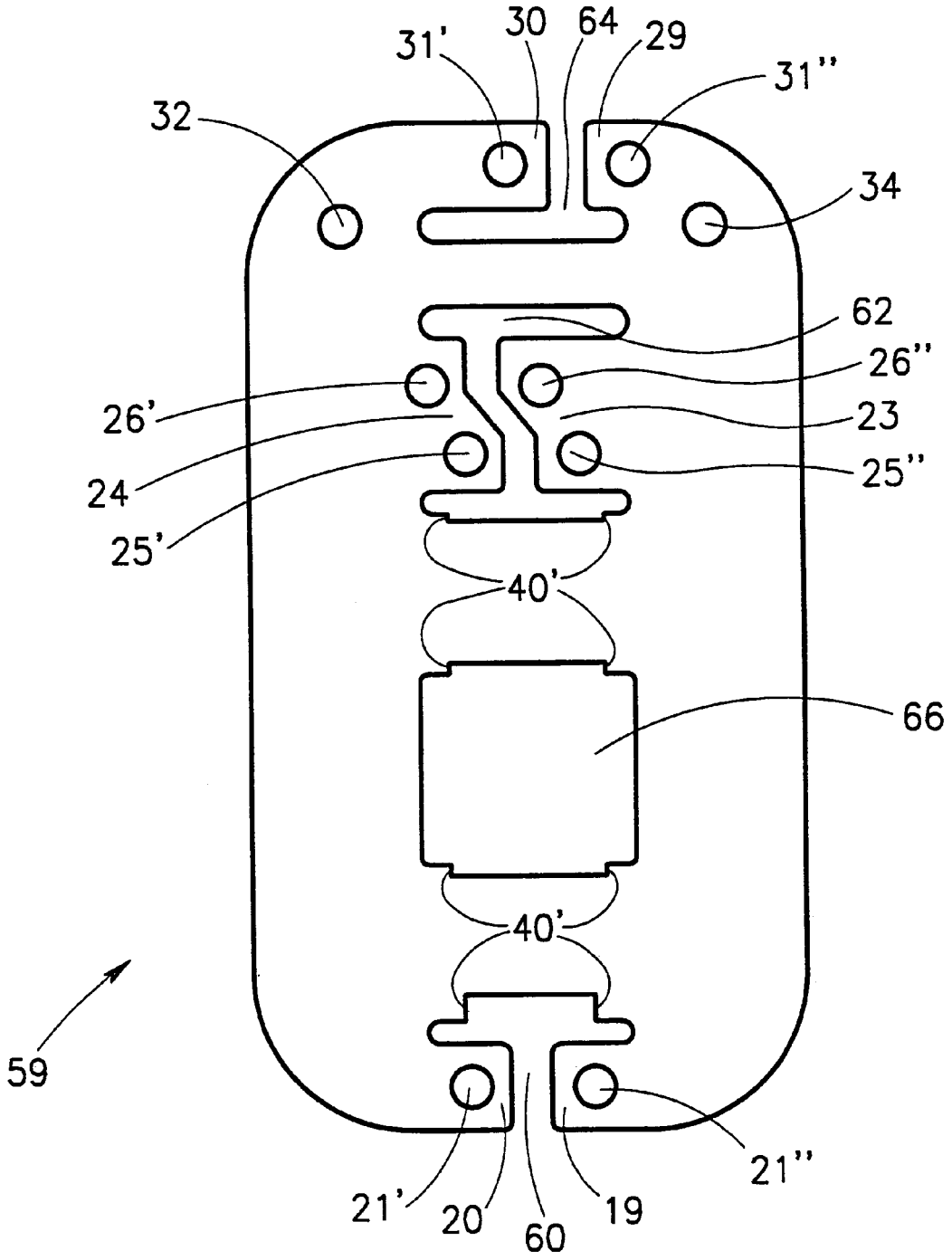
FIG. 4 is a plan view of a metal sheet blank useful in preparation of a wall bracket in accordance with the present invention.

Reference is now made to FIGS. 4 to 6 for explaining how the wall bracket according to the invention is manufactured. At the first stage of manufacture, as seen in FIG. 4, a blank is cut of a metal sheet and suitable openings 62 and 64 are formed therein for facilitating in forming the overlapping portions 18, 22 and 28 respectively. Also, a plurality of pairs of holes 21', 21"; 25', 25"; 26', 26" and 31', 31" are formed, which at the overlapping position will form the holes 21, 25, 26 and 31 respectively. Additional holes 32 and 34 are also formed in the blank as well as a central opening 66 which is made for facilitating the bending of the blank. The blank also comprises suitable sections 40' which will constitute the shoulders 40 of the wall bracket.

Typically, the metal sheet is made of a steel suitable for bending and is about 3±2 mm thick. However, a preferred thickness is about 2.5 mm. It should be appreciated that a preferable method for forming the blank 59 seen in FIG. 4 with the openings and holes is by a pressing process, however it should be appreciated that other machining method may be used e.g., drilling, milling, wire cutting, etc.

The ready blank 59 is then placed over a suitable matrix (not shown) which matrix comprises surfaces for bending one member 19, 23, and 30 of the overlapping portions 18, 22 and 28 respectively, as seen in FIGS. 5*c* to 5*e*. The matrix further comprises suitable surfaces for bending the side edges 46. Then a first pressing process takes place wherein the blank obtains the shape as seen in FIGS. 5*a* to 5*e*.

At a second pressing process, the blank is transferred to a second matrix (not shown) and a suitable press (not shown) is used for forming the U-shaped eye hinges 12 and 13 as well as the bend 44, whereby the wall bracket obtains its final shape as seen in FIGS. 2 and 6.

Figure 3B:
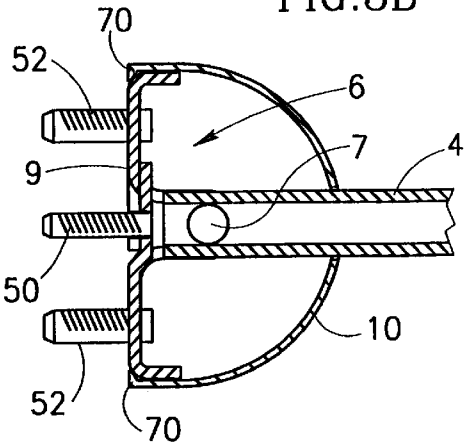
FIG. 3*b* is a cross-sectional view along line IV—IV in FIG. 3, illustrating how a decorative cover is attached to the wall bracket.
Figure 3A:
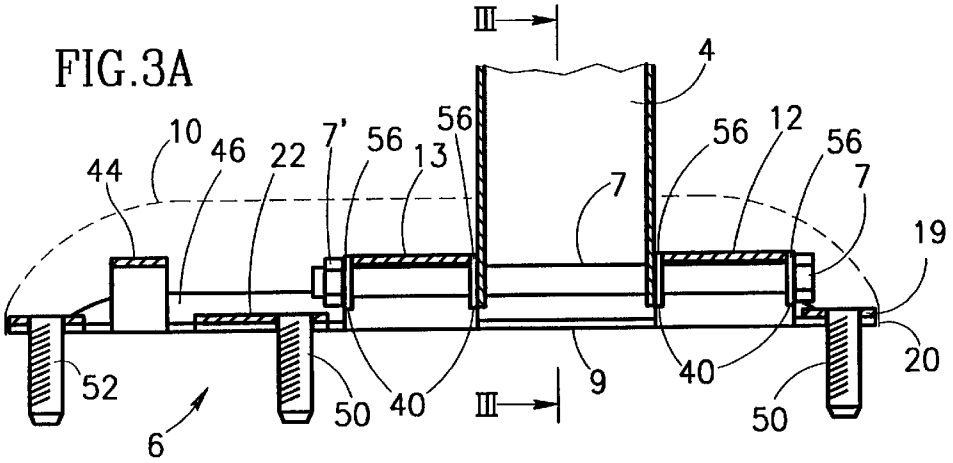
FIG. 3*a* is a cross-sectional view along line III—III in FIG. 2, also showing a portion of the arm and a decorative cover in phantom lines.

Attention is now directed to FIGS. 3*a* and 3*b* for understanding how the decorative cover 10 is attached to the wall bracket 6. Prior to articulating the support arm 4 to the wall bracket 6, the arm 4 is inserted through opening 11 of the decorative cover 10 as seen in FIG. 1 then, the cover 10 is pushed against the wall bracket 6 allowing protrusions 70 of the cover 10 (seen in FIG. 3*b*) to snap-fit into a gap behind the radii of the folded edges 46, as seen in FIGS. 3. Detaching the decorative cover 10 from the wall bracket 6 is merely by pulling the cover away from the wall bracket against the elasticity of the cover.

It should be appreciated that manufacture of the wall bracket 6 does not require any additional components, but rather consists of single metal sheet, and preferably, it is manufactured only by pressing processes. Furthermore, other designs of wall brackets may be used by forming holes at different locations, providing additional bends for increasing bending durability of the bracket, etc.

Figure 7:
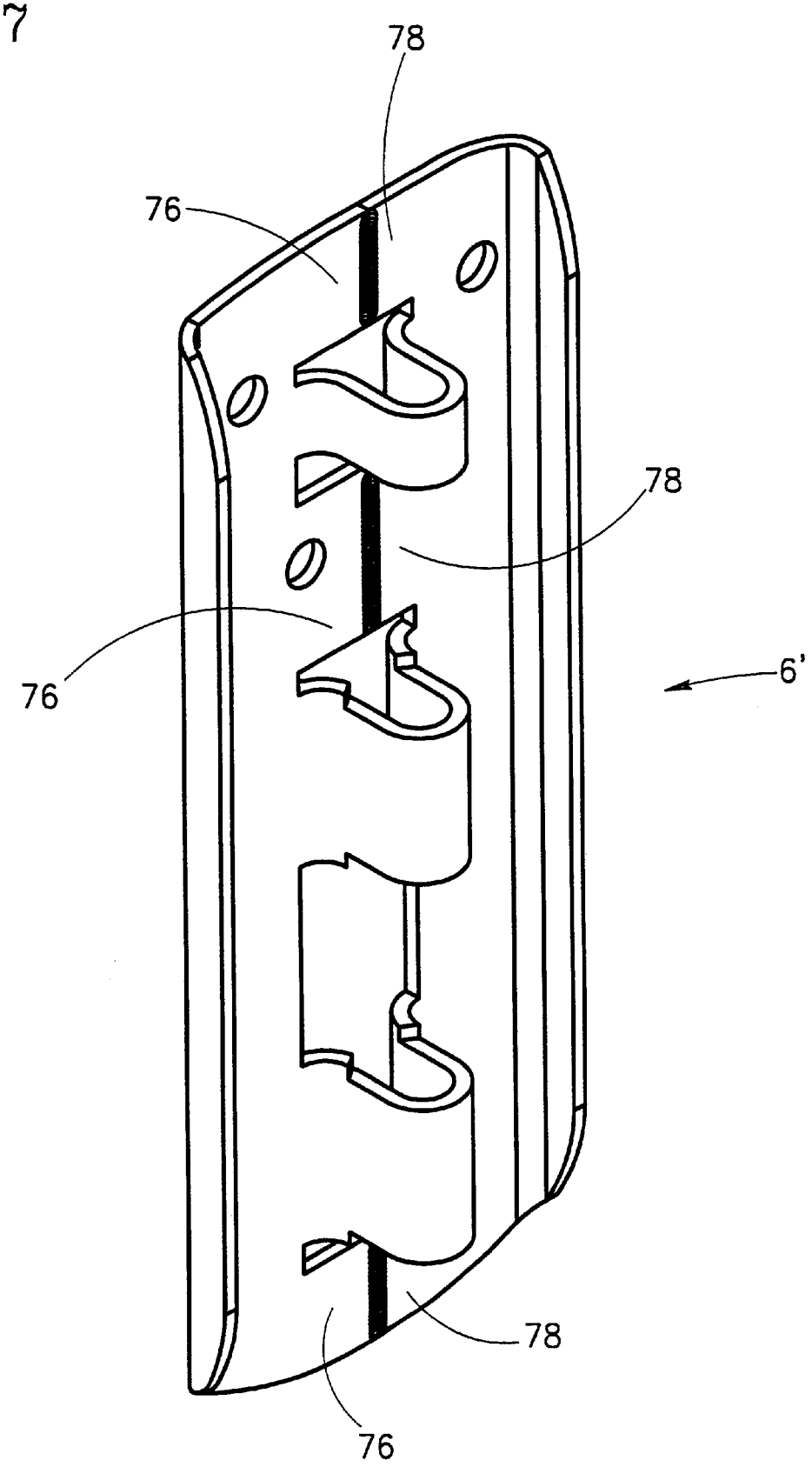
FIG. 7 is another embodiment of a wall bracket according to the invention manufactured.

Referring now to FIG. 7 of the drawings, another embodiment of the invention has a similar structure, however lateral deformation of the bracket is obtained by producing equi-leveled, flat portions 76 and 78 extending from opposite sides of the wall bracket 6', whereby after obtaining the final shape of the bracket surfaces of the flat portions 76 band 78 are flush with one another and tangential edges thereof are welded along line 80 as known per se.

I claim:

1. A wall bracket fixable to a wall for supporting an articulated support arm, the bracket characterized in that it is made of a single metal sheet blank bent along a longitudinal axis so as to form an essentially flat wall plate comprising at least one first eye hinge and one second eye hinge projecting from the wall plate for receiving a hinge shaft, each eye hinge having an axial width larger than a thickness of the sheet blank and not aligned with each other while extending along the longitudinal axis, wherein each first and second eye hinge has an essentially U-like shape and leg portions connected to the wall plate.

2. A wall bracket according to claim 1, further comprising at least two overlapping portions consisting of a first and second member, each extending from an opposite direction, and a hole extending through each one of said portions.

3. A wall bracket according to claim 2, wherein a fastener inserted into the holes of the overlapping portions prevents deformation of the bracket.

4. A wall bracket according to claim 3, wherein the fasteners are bolts used for mounting the wall bracket to the wall.

5. A wall bracket according to claim 2, wherein a first one of said portions is adjacent the first eye hinge and a second one of said portions is adjacent the second eye hinge.

6. A wall bracket according to claim 5, wherein the first overlapping portion is adjacent a bottom end of the wall bracket and a third overlapping portion is provided adjacent a top end of the wall bracket.

7. A wall bracket according to claim 6, wherein the horizontal distance between the center of any two holes is not more than about 20 mm.

8. A wall bracket according to claim 6, wherein at least two facing edges of the at least two adjacent eye hinges comprises axial projecting shoulders for positioning retaining rings coaxially with the hinge eyes for radially positioning of the hinge shaft within the hinge eyes.

9. A wall bracket according to claim 8, wherein the rings further serve to reduce friction between the support arm and the hinges.

10. A wall bracket according to claim 6, wherein side edges of the wall plate are bent along an axis parallel to the longitudinal axis, so as to impart bending resistance to the wall bracket.

11. A wall bracket according to claim 5, wherein the second overlapping portion comprises two holes, one of which being in alignment with a hole of the first overlapping portion and along the longitudinal axis.

12. A wall bracket according to claim 1, wherein the support arm is swingingly articulated to the wall bracket.

13. A wall bracket according to claim 1, wherein the wall plate comprises at least two additional holes.

14. A wall bracket according to claim 13, wherein the additional holes are adjacent the top end of the wall bracket and near side edges thereof.

15. A wall bracket according to claim 1, being concealable by a decorative cover.

16. A wall bracket according to claim 15, wherein the decorative cover snap-fits over the wall bracket by protrusions fitted for attachment to the wall bracket behind the bent side edges of thereof.

17. A wall bracket according to claim 1, wherein a length of the at least one first eye hinge and one second eye hinge measured along the longitudinal axis is essentially larger than a thickness of the metal sheet.

18. A method for manufacturing a wall bracket for hingingly supporting an articulated support arm to a wall, the method consisting of the following steps:

(a) forming a metal sheet into to a blank including forming suitable openings and holes;

(b) forming at least two axially aligned eye hinges, whereby the blank is laterally deformed so that essentially flat portions project from opposite sides of the wall bracket;

(c) fixedly attaching the flat portions to one another along their tangential edges.

19. A method according to claim 18, wherein attaching the flat portions is by welding.

20. A method according to claim 18, further comprising a step of bending side edges of the blank parallel to a longitudinal axis of the blank, before step (b).

21. A method according to claim 18, wherein the wall bracket is manufactured only by pressing processes.

22. A method for manufacturing a wall bracket for hingingly supporting an articulated support arm to a wall, the method consisting of the following steps:

(a) forming a metal sheet into to a blank including forming suitable openings, and holes at each member of the overlapping portions;

(b) bending side edges of the blank parallel to a longitudinal axis of the blank;

(c) before, after or during step (b) bending one member of each of the overlapping portions so as to extend parallel to the sheet and essentially flush with a surface of the sheet;

(d) forming at least two axially aligned eye hinges, whereby the blank is laterally deformed and the members of each of the overlapping portions overlap so that the holes become concentric.

23. A method according to claim 22, further including forming additional holes in the blank before step (b).

24. A method according to claim 22, wherein the wall bracket is manufactured only by pressing processes.

* * * * *